US011286938B2

(12) United States Patent
Hebrard et al.

(10) Patent No.: US 11,286,938 B2
(45) Date of Patent: Mar. 29, 2022

(54) OIL SEPARATOR AND RELIEF VALVE OF A SCREW COMPRESSOR FOR A UTILITY VEHICLE

(71) Applicant: KNORR-BREMSE Systeme fuer Nutzfahrzeuge GmbH, Munich (DE)

(72) Inventors: Gilles Hebrard, Munich (DE); Jean-Baptiste Marescot, Munich (DE); Joerg Mellar, Munich (DE); Thomas Weinhold, Munich (DE)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 327 days.

(21) Appl. No.: 16/333,526

(22) PCT Filed: Sep. 19, 2017

(86) PCT No.: PCT/EP2017/073545
§ 371 (c)(1),
(2) Date: May 15, 2019

(87) PCT Pub. No.: WO2018/054861
PCT Pub. Date: Mar. 29, 2018

(65) Prior Publication Data

US 2019/0338776 A1 Nov. 7, 2019

(30) Foreign Application Priority Data

Sep. 21, 2016 (DE) ..... 10 2016 011 432.0

(51) Int. Cl.
*F04C 29/02* (2006.01)
*F04C 28/28* (2006.01)
*F04C 18/16* (2006.01)

(52) U.S. Cl.
CPC ..... *F04C 29/026* (2013.01); *F04C 18/16* (2013.01); *F04C 28/28* (2013.01);
(Continued)

(58) Field of Classification Search
CPC .... F04C 2280/04; F04C 29/026; F04C 18/16; F04C 2240/30; F04C 28/28
See application file for complete search history.

(56) References Cited

U.S. PATENT DOCUMENTS 2,311,655 A 2/1943 Freeman et al.
5,454,700 A 10/1995 Iguchi et al.
(Continued)

FOREIGN PATENT DOCUMENTS

AT 401 551 B 10/1996
CN 1550673 A 12/2004
(Continued)

OTHER PUBLICATIONS

Machine Translation German Patent Publication DE 10 2014 118 266 B3, Inventor: Bock, Published Jun. 2, 2016. (Year: 2016).*
(Continued)

*Primary Examiner* — Mary Davis
(74) *Attorney, Agent, or Firm* — Crowell & Moring LLP

(57) ABSTRACT

A screw compressor for a utility vehicle includes at least one housing and at least one air-oil separator holder arranged at the housing. The air-oil separator holder is manufactured from a non-corrosive material. A relief valve is provided, which is arranged in the air-oil separator holder and by which the interior of the screw compressor can be relieved of pressure.

4 Claims, 2 Drawing Sheets

(52) U.S. Cl.
CPC ..... *F04C 2240/30* (2013.01); *F04C 2280/04* (2013.01); *F05C 2201/021* (2013.01); *F05C 2201/0439* (2013.01); *F05C 2225/00* (2013.01)

(56) References Cited

U.S. PATENT DOCUMENTS

| | | | | |
|---|---|---|---|---|
| 5,584,673 | A | 12/1996 | Rein | |
| 6,065,944 | A * | 5/2000 | Cobb | F04B 43/113 417/394 |
| 6,349,743 | B1 | 2/2002 | Staiger et al. | |
| 2004/0208771 | A1 | 10/2004 | Ohsumimoto et al. | |
| 2006/0260340 | A1 | 11/2006 | Bhatia et al. | |
| 2009/0041589 | A1 | 2/2009 | Liebert et al. | |
| 2014/0017110 | A1 | 1/2014 | Zemliak | |
| 2016/0115950 | A1 | 4/2016 | Ikeda et al. | |

FOREIGN PATENT DOCUMENTS

| | | | |
|---|---|---|---|
| CN | 101163888 | A | 4/2008 |
| CN | 201265528 | Y | 7/2009 |
| CN | 201650673 | U | 11/2010 |
| CN | 102287373 | A | 12/2011 |
| CN | 103174652 | B | 8/2015 |
| CN | 105673485 | A | 6/2016 |
| DE | 81 36 225 | U1 | 2/1983 |
| DE | 35 17 493 | A1 | 11/1986 |
| DE | 41 31 857 | C2 | 7/1993 |
| DE | 44 15 875 | A1 | 11/1994 |
| DE | 100 26 086 | A1 | 12/2001 |
| DE | 10 2005 010 690 | A1 | 9/2006 |
| DE | 10 2011 014 961 | A1 | 9/2012 |
| DE | 10 2014 118 266 | B3 | 6/2016 |
| JP | 56-121889 | A | 9/1981 |
| JP | 9-60596 | A | 3/1997 |
| JP | 2008-533354 | A | 8/2008 |
| WO | WO 2015/168101 | A1 | 11/2015 |

OTHER PUBLICATIONS

Japanese-language Office Action issued in Japanese Application No. 2019-536670 dated May 28, 2020 with English translation (10 pages).

International Search Report (PCT/ISA/210) issued in PCT Application No. PCT/EP2017/073545 dated Nov. 24, 2017 with English translation (seven (7) pages).

International Preliminary Report on Patentability (PCT/IB/326 & PCT/IB/373) issued in PCT Application No. PCT/EP2017/073545 dated Apr. 4, 2019, including English translation of document C2 (German-language Written Opinion (PCT/ISA/237) previously filed on Mar. 14, 2019) (eight (8) pages).

Chinese-language Office Action issued in counterpart Chinese Application No. 201780069931.9 dated Nov. 29, 2019 with partial English translation (nine (9) pages).

Korean-language Office Action issued in Korean Application No. 10-2019-7009362 dated Apr. 20, 2020 with English translation (10 pages).

Korean-language Office Action issued in Korean Application No. 10-2019-7009362 dated Oct. 15, 2020 with English translation (10 pages).

* cited by examiner

OIL SEPARATOR AND RELIEF VALVE OF A SCREW COMPRESSOR FOR A UTILITY VEHICLE

BACKGROUND AND SUMMARY OF THE INVENTION

The present invention relates to a screw compressor for a utility vehicle, having at least one housing and having at least one air oil separator holder arranged on the housing.

Screw compressors for utility vehicles are already known from the prior art. Such screw compressors are used to provide the compressed air required for the brake system of the utility vehicle, for example.

In this context, in particular oil-filled compressors, in particular also screw compressors, are known, in the case of which it is necessary to regulate the oil temperature. This is generally realized by virtue of an external oil cooler being provided which is connected to the oil-filled compressor and to the oil circuit via a thermostat valve. Here, the oil cooler is a heat exchanger which has two mutually separate circuits, wherein the first circuit is provided for the hot liquid, that is to say the compressor oil, and the second circuit is provided for the cooling liquid. As cooling liquid, use may for example be made of air, water mixtures with an antifreeze, or another oil.

This oil cooler must then be connected to the compressor oil circuit by means of pipes or hoses, and the oil circuit must be safeguarded against leakage.

This external volume must furthermore be filled with oil, such that the total quantity of oil is also increased. The system inertia is thus increased. Furthermore, the oil cooler must be mechanically accommodated and fastened, either by means of brackets situated in the surroundings or by means of a separate bracket, which necessitates additional fastening means and also structural space.

DE 41 31 857 C2 has disclosed for example a screw compressor which has a housing-side oil separator.

DE 44 15 875 A1 has already disclosed a screw compressor which has an aluminum housing.

It is the object of the present invention to advantageously further develop a screw compressor for a utility vehicle of the type mentioned in the introduction, in particular such that the corrosion of components of the screw compressor can be prevented, or does not occur in the first place.

This object is achieved according to the invention by a screw compressor for a utility vehicle to be equipped with at least one housing and with at least one air oil separator holder arranged on the housing, wherein the air oil separator holder is manufactured from non-corrosive material, and wherein a relief valve is provided which is arranged in the air oil separator holder and by which the interior of the screw compressor can be relieved of pressure.

The invention is based on the underlying concept of the relief valve, the ports and the surroundings of which, from experience, attract moisture precipitation, being arranged at a location in the screw compressor at which no corrosion can occur. In this context, it is proposed that the air oil separator holder be manufactured from non-corrosive material, and that the relief valve, by which the interior of the screw compressor can be relieved of pressure, be arranged there. In this way, the occurrence of corrosion in the housing of the screw compressor is avoided. Those regions in which, from experience, corrosion occurs in a screw compressor are thus relocated into regions of the screw compressor in which no corrosion can occur, because only non-corrosive material is present there.

Provision may be made for the non-corrosive material to be composed at least partially of aluminum, or to be composed at least partially of an aluminum alloy. In this way, simple manufacturing, for example by casting or cutting processes, is made possible. Furthermore, adequate stability can be achieved. Aluminum or aluminum alloys can furthermore be used in an effective manner as suitable non-corrosive materials.

The relief valve may be connected to the air inlet of the screw compressor. In this way, a simple construction for the release of pressure from the screw compressor is provided. The cross sections of the air inlet are furthermore well-suited to effecting a release of pressure.

Provision may furthermore be made for the connection of relief valve to the air inlet of the screw compressor to be led at least partially outside the housing of the screw compressor. In this way, cumbersome guides and compressed-air connections between the relief valve and the air inlet in the interior of the housing of the screw compressor are avoided. A simple and reliable connection, which can possibly also be correspondingly maintained or equipped with replacement parts, is thus possible.

Provision may furthermore be made for the connection of relief valve to the air inlet of the screw compressor to be formed at least partially by a plastics hose. In this way, a simple and reliable non-corrosive connection is formed between the relief valve and the air inlet. The plastics hose may in particular also be led outside the housing of the screw compressor.

The relief valve may be connectable via the air inlet to the atmosphere. In this way, a simple and reliable dissipation of pressure from the relief valve via the air inlet is made possible.

Provision may furthermore be made for the housing to be composed of a different material than the air oil separator holder. This permits cheaper and simpler production, because it is not imperatively necessary for all of the constituent parts of the screw compressor to be manufactured from non-corrosive material, and it is also not necessary for all of the constituent parts of the housing of the screw compressor to be manufactured from non-corrosive material. Respectively suitable materials, which also correspondingly satisfy the cost requirements, can thus be selected. The costs of the screw compressor can be favorably influenced in this way.

The housing may be composed of a cast material, in particular of cast iron. Simple and inexpensive production is made possible in this way.

Further details and advantages of the invention will now be discussed in more detail on the basis of an exemplary embodiment illustrated in the drawings.

DETAILED DESCRIPTION OF THE DRAWINGS

Figure 1:
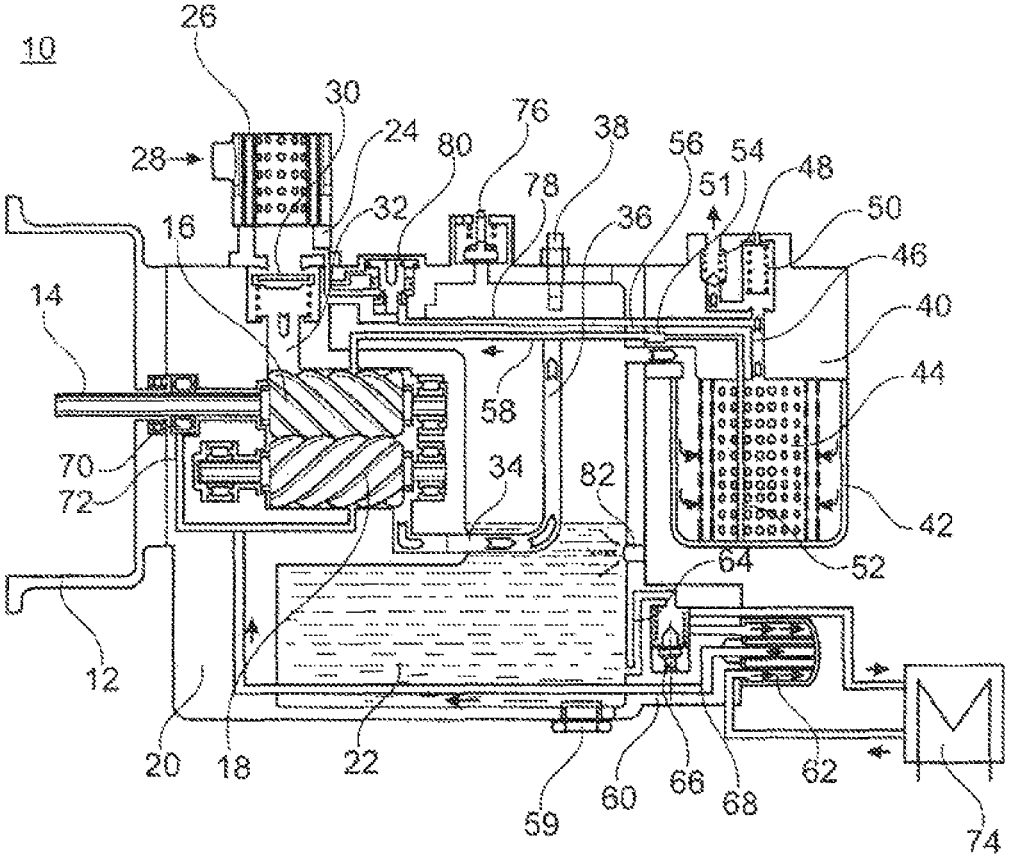
FIG. 1 shows a schematic sectional drawing through a screw compressor according to the invention.

FIG. 1 shows, in a schematic sectional illustration, a screw compressor 10 in the context of an exemplary embodiment of the present invention.

The screw compressor 10 has a fastening flange 12 for the mechanical fastening of the screw compressor 10 to an electric motor (not shown in any more detail here).

What is shown, however, is the input shaft 14, by which the torque from the electric motor is transmitted to one of the two screws 16 and 18, specifically the screw 16.

The screw 18 meshes with the screw 16 and is driven by means of the latter.

The screw compressor 10 has a housing 20 in which the main components of the screw compressor 10 are accommodated.

The housing 20 is filled with oil 22.

At the air inlet side, an inlet connector 24 is provided on the housing 20 of the screw compressor 10. The inlet connector 24 is in this case designed such that an air filter 26 is arranged at said inlet connector. Furthermore, an air inlet 28 is provided radially on the air inlet connector 24.

In the region between the inlet connector 24 and the point at which the inlet connector 24 joins to the housing 20, there is provided a spring-loaded valve insert 30, which is designed here as an axial seal.

The valve insert 30 serves as a check valve.

Downstream of the valve insert 30, there is provided an air feed channel 32 which feeds the air to the two screws 16, 18.

At the outlet side of the two screws 16, 18, there is provided an air outlet pipe 34 with a riser line 36.

In the region of the end of the riser line 36, there is provided a temperature sensor 38 by means of which the oil temperature can be monitored.

Also provided in the air outlet region is a holder 40 for an air deoiling element 42.

In the assembled state, the holder 40 for the air deoiling element has the air deoiling element 42 in the region facing toward the base (as also shown in FIG. 1).

Also provided, in the interior of the air deoiling element 42, is a corresponding filter screen or known filter and oil separating devices 44, which will not be specified in any more detail.

In the central upper region in relation to the assembled and operationally ready state (that is to say as shown in FIG. 1), the holder 40 for the air deoiling element 42 has an air outlet opening 46 which leads to a check valve 48 and a minimum pressure valve 50. The check valve 48 and the minimum pressure valve 50 may also be formed in one common combined valve.

The air outlet 51 is provided downstream of the check valve 48.

The air outlet 51 is generally connected to correspondingly known compressed-air consumers.

In order for the oil 22 that is situated and separated off in the air deoiling element 42 to be returned again into the housing 20, a riser line 52 is provided which has a filter and check valve 54 at the outlet of the holder 40 for the air deoiling element 42 at the transition into the housing 20.

A nozzle 56 is provided, downstream of the filter and check valve 54, in a housing bore. The oil return line 58 leads back into approximately the central region of the screw 16 or of the screw 18 in order to feed oil 22 thereto again.

An oil drain screw 59 is provided in the base region, in the assembled state, of the housing 20. By means of the oil drain screw 59, a corresponding oil outflow opening can be opened, via which the oil 22 can be drained.

Also provided in the lower region of the housing 20 is the attachment piece 60 to which the oil filter 62 is fastened. Via an oil filter inlet channel 64, which is arranged in the housing 20, the oil 22 is conducted firstly to a thermostat valve 66.

Instead of the thermostat valve 66, it is possible for an open-loop and/or closed-loop control device to be provided by which the oil temperature of the oil 22 situated in the housing 20 can be monitored and set to a setpoint value.

Downstream of the thermostat valve 66, there is then the oil inlet of the oil filter 62, which, via a central return line 68, conducts the oil 22 back to the screw 18 or to the screw 16 again, and also to the oil-lubricated bearing 70 of the shaft 14. Also provided in the region of the bearing 70 is a nozzle 72, which is provided in the housing 20 in conjunction with the return line 68.

The cooler 74 is connected to the attachment piece 60.

In the upper region of the housing 20 (in relation to the assembled state), there is situated a safety valve 76, by which an excessively high pressure in the housing 20 can be dissipated.

Upstream of the minimum pressure valve 50, there is situated a bypass line 78, which leads to a relief valve 80. Via said relief valve 80, which is activated by a connection to the air feed 32, air can be returned into the region of the air inlet 28. In this region, there may be provided a ventilation valve (not shown in any more detail) and also a nozzle (diameter constriction of the feeding line).

Furthermore, approximately at the level of the line 34, an oil level sensor 82 may be provided in the outer wall of the housing 20. Said oil level sensor 82 may for example be an optical sensor, and may be designed and configured such that, on the basis of the sensor signal, it can be identified whether the oil level during operation is above the oil level sensor 82 or whether the oil level sensor 82 is exposed, and thus the oil level has correspondingly fallen.

In conjunction with this monitoring, it is also possible for an alarm unit to be provided which outputs or transmits a corresponding error message or warning message to the user of the system.

The function of the screw compressor 10 shown in FIG. 1 is as follows.

Air is fed via the air inlet 28 and passes via the check valve 30 to the screws 16, 18, where the air is compressed. The compressed air-oil mixture, which, having been compressed by a factor of between 5 and 16 downstream of the screws 16 and 18, rises through the outlet line 34 via the riser pipe 36, is blown directly onto the temperature sensor 38.

The air, which still partially carries oil particles, is then conducted via the holder 40 into the air deoiling element 42 and, if the corresponding minimum pressure is attained, passes into the air outlet line 51.

The oil 22 situated in the housing 20 is kept at operating temperature via the oil filter 62 and possibly via the heat exchanger 74.

If no cooling is necessary, the heat exchanger 74 is not used and is also not activated.

The corresponding activation is performed by means of the thermostat valve 66. After purification in the oil filter 62, oil is fed via the line 68 to the screw 18 or to the screw 16, and also to the bearing 70. The screw 16 or the screw 18 is supplied with oil 22 via the return line 52, 58, and the purification of the oil 22 takes place here in the air deoiling element 42.

By means of the electric motor (not shown in any more detail), which transmits its torque via the shaft 14 to the screw 16, which in turn meshes with the screw 18, the screws 16 and 18 of the screw compressor 10 are driven.

By means of the relief valve 80 (not shown in any more detail), it is ensured that the high pressure that prevails for example at the outlet side of the screws 16, 18 in the operational state cannot be enclosed in the region of the feed line 32, but that, instead, in particular during the start-up of the compressor, there is always a low inlet pressure, in particular atmospheric pressure, prevailing in the region of the feed line 32. Otherwise, upon a start-up of the compressor, a very high pressure would initially be generated at the outlet side of the screws 16 and 18, which would overload the drive motor.

Figure 2:
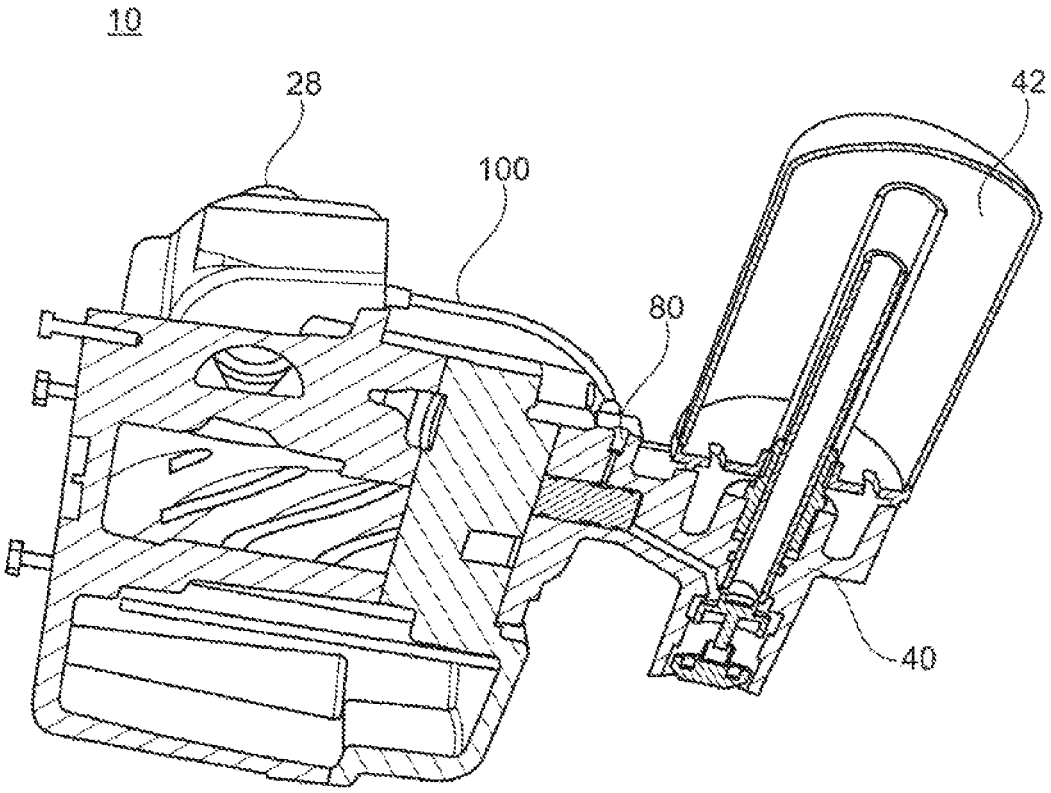
FIG. 2 shows a perspective sectional view of the screw compressor, with a detail illustration of the air oil separator holder of the screw compressor.

FIG. 2 shows, in a schematic sectional illustration, a section through the screw compressor 10 in a perspective view.

The air oil separator holder 40 is in this case manufactured from aluminum, and is fastened to the outer side of the housing 20 of the screw compressor 10. The air oil separator 42 or the air deoiling element 42 is mounted on the air oil separator holder 40.

Furthermore, the relief valve 80 is arranged in the air oil separator holder 40. The outlet of the relief valve 80 is connected by means of a plastics hose 100, which runs outside the housing 20, to the air inlet 28 of the screw compressor 10, whereby the outlet of the relief valve 80 is connectable to the atmosphere.

Here, by contrast to the air oil separator holder 40, the housing 20 is composed of gray cast iron, and is thus manufactured from a different material than the air oil separator holder 40.

By means of the arrangement of the relief valve 80 in the air oil separator holder 40 which is manufactured from aluminum, it is achieved that precipitation of moisture that occurs there cannot lead to corrosion, because the air oil separator holder 40 is composed of non-corrosive material.

The connection of the outlet of the relief valve 80 via the plastics hose 100 to the air inlet 28 furthermore eliminates the need for the connection between relief valve 80 and the air inlet 28 to be led through the housing 20. Furthermore, in a known manner, a connecting line with a small cross section is susceptible to precipitation of moisture and thus to corrosion.

By virtue of the fact that the connection is produced by means of a plastics hose 100, corrosion is avoided. Furthermore, in the event of a possible blockage of the connection, said plastics hose can be easily exchanged because it runs outside the housing 20.

LIST OF REFERENCE DESIGNATIONS

10 Screw compressor
12 Fastening flange
14 Input shaft
16 Screws
18 Screws
20 Housing
22 Oil
24 Inlet connector
26 Air filter
28 Air inlet
30 Valve insert
32 Air feed channel
34 Air outlet pipe
36 Riser line
38 Temperature sensor
40 Holder for an air deoiling element
42 Air deoiling element
44 Filter screen or known filter or oil separation devices
46 Air outlet opening
48 Check valve
50 Minimum pressure valve
51 Air outlet
52 Riser line
54 Filter and check valve
56 Nozzle
58 Oil return line
59 Oil drain screw
60 Attachment piece
**60*a*** Outer ring
**60*b*** Inner ring
62 Oil filter
64 Oil filter inlet channel
66 Thermostat valve
68 Return line
70 Bearing
72 Nozzle
74 Cooler, heat exchanger
76 Safety valve
78 Bypass line
80 Relief valve
82 Oil level sensor
100 Plastics hose

What is claimed is:

1. A screw compressor for a utility vehicle, comprising:
at least one housing; and
at least one air oil separator holder arranged on the housing,
wherein
the air oil separator holder is manufactured from non-corrosive material, and
a relief valve is provided, which is arranged in the air oil separator holder, and by which an interior of the screw compressor is relievable of pressure down to a predetermined pressure level,
the relief valve is connected to an air inlet of the screw compressor,
the relief valve is connectable via the air inlet to atmosphere,
the housing is composed of a different material than the air oil separator holder,
the connection of the relief valve to the air inlet of the screw compressor is led at least partially outside the housing of the screw compressor, and
the connection of the relief valve to the air inlet of the screw compressor is formed at least partially by a plastic hose.

2. The screw compressor as claimed in claim 1, wherein the non-corrosive material is composed at least partially of aluminum, or is composed at least partially of an aluminum alloy.

3. The screw compressor as claimed in claim 1, wherein the housing is composed of cast material.

4. The screw compressor as claimed in claim 1, wherein the housing is composed of cast iron.

* * * * *